US007448960B2

(12) United States Patent
Gibbs et al.

(10) Patent No.: US 7,448,960 B2
(45) **Date of Patent: *Nov. 11, 2008**

(54) GOLF CLUB HEAD WITH VARIABLE FACE THICKNESS

(75) Inventors: Evan D. Gibbs, Carlsbad, CA (US); J. Andrew Galloway, Escondido, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/928,318

(22) Filed: Oct. 30, 2007

(65) Prior Publication Data

US 2008/0051217 A1 Feb. 28, 2008

Related U.S. Application Data

(63) Continuation of application No. 11/841,384, filed on Aug. 20, 2007, which is a continuation of application No. 11/469,742, filed on Sep. 1, 2006, now Pat. No. 7,258,626, which is a continuation of application No. 10/904,332, filed on Nov. 4, 2004, now Pat. No. 7,101,289, which is a continuation-in-part of application No. 10/711,825, filed on Oct. 7, 2004, now Pat. No. 7,137,907.

(51) Int. Cl.
*A63B 53/047* (2006.01)

(52) U.S. Cl. ..... 473/329; 473/342; 473/345; 473/349

(58) Field of Classification Search ..... 473/324–350, 473/287–292
See application file for complete search history.

(56) References Cited

U.S. PATENT DOCUMENTS

| | | | | |
|---|---|---|---|---|
| 2,087,685 | A | 7/1937 | Hackney | |
| 3,814,437 | A | 6/1974 | Winquist | |
| 4,919,430 | A | 4/1990 | Antonious | |
| 5,401,021 | A | 3/1995 | Allen | |
| 5,595,552 | A | 1/1997 | Wright et al. | |
| 5,643,108 | A | 7/1997 | Cheng | |
| 5,830,084 | A | 11/1998 | Kosmatka | |
| 5,971,868 | A | 10/1999 | Kosmatka | |
| 6,800,039 | B1 | 10/2004 | Tseng | |
| 6,926,618 | B2 | 8/2005 | Sanchez et al. | |
| 6,960,142 | B2 | 11/2005 | Bissonnette et al. | |
| 7,101,289 | B2 | 9/2006 | Gibbs et al. | |
| 7,137,907 | B2 * | 11/2006 | Gibbs et al. | 473/329 |
| 7,258,626 | B2 * | 8/2007 | Gibbs et al. | 473/329 |

* cited by examiner

*Primary Examiner*—Sebastiano Passaniti
(74) *Attorney, Agent, or Firm*—Michael A. Catania; Elaine H. Lo

(57) ABSTRACT

A face or face insert (40) for a golf club head (20) is disclosed herein. The face (40) has an interior surface (40*a*) with a first thickness section (200) and a second thickness region (205). The first thickness section (200) preferably has a thickness that is at least 0.025 inch greater than the thickness of the second thickness region (205). In a most preferred embodiment, the first thickness section (205) has a X shape. The face or face insert (40) with variable thickness allows for a face or face insert (40) with less mass in a golf club head (20) that conforms to the United States Golf Association regulations.

7 Claims, 11 Drawing Sheets

GOLF CLUB HEAD WITH VARIABLE FACE THICKNESS

CROSS REFERENCES TO RELATED APPLICATIONS

The Present Application is a continuation application of U.S. patent application Ser. No. 11/841,384, filed on Aug. 20, 2007, which is a continuation application of U.S. patent application Ser. No. 11/469,742, filed on Sep. 1, 2006, now U.S. Pat. No. 7,258,626, which is a continuation application of U.S. patent application Ser. No. 10/904,332, filed on Nov. 4, 2004, now U.S. Pat. No. 7,101,289, which is a continuation-in-part application of U.S. patent application Ser. No. 10/711,825, filed on Oct. 7, 2004, now U.S. Pat. No. 7,137,907.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head with variable face thickness.

2. Description of the Related Art

Conventional golf club head designs are limited with regard to the maximum face area, both physical and practical limitations. The physical limitation is due to the golf club head having insufficient mass to both increase the length and width of the golf club head and also to increase the face size without exceeding the upper range of the preferred total golf club head increase the face size without exceeding the upper range of the preferred total golf club head mass. Such mass distributions are dependent on minimum wall thickness values required to achieve acceptable in-service durability.

Further, the thinning of the face thickness of a large face area golf club head will result in a golf club head that does not conform with the United States Golf Association's "Pendulum Test" which measures the characteristic time of the golf club head. The characteristic time is the contact time between metal mass attached to a pendulum that strikes the face center of the golf club head at a low speed. The limit is 239 microseconds with a test tolerance of 18 microseconds. The United States Golf Association ("USGA") states that this characteristic time corresponds to a coefficient of restitution of 0.822 with a test tolerance of 0.008.

Uniformly increasing the thickness of the face portion typically requires the addition of large amounts of material to adequately reduce the stress sufficient to prevent impact and/or fatigue cracking. However, the addition of such a large amount of material to a face generally adversely affects the performance of the golf club.

One of the first patents to disclose variable face thickness was U.S. Pat. No. 5,318,300 to Schmidt et al., for a Metal Wood Golf Club With Variable Faceplate Thickness which was filed on Nov. 2, 1992. Schmidt et al discloses thickening the faceplate to prevent cracking.

A further disclosure of variable face thickness is disclosed in U.S. Pat. No. 5,830,084 to Kosmatka for a Contoured Golf Club Face which was filed on Oct. 23, 1996. Kosmatka addresses contouring the face to thicken certain regions while thinning other regions depending on the stress load experienced by such regions. Kosmatka also discloses a method for designing a face plate according to measured stress levels experienced during impact with a golf ball. Kosmatka, U.S. Pat. No. 5,971,868 for a Contoured Back Surface Of Golf Club Face, filed on Nov. 18, 1997, discloses similar contouring for an iron.

A more recent disclosure is Noble et al., U.S. Pat. No. 5,954,596, for a Golf Club Head With Reinforced Front Wall, which was filed on Dec. 4, 1997. Noble et al. discloses a face plate with the thickness portion at the geometric center, and gradually decreasing toward the top and bottom, and the sole and heel. The top and bottom ends along a line through geometric center have the same thickness, and the heel and sole ends along a line through geometric center have the same thickness.

Other references make partial disclosure of varying face thickness. One example is FIG. 8 of U.S. Pat. No. 5,505,453 which illustrates an interior surface of a face with a bulging center and decreasing thickness towards the heel and sole ends, similar to Noble et al. Another example is FIGS. 4C and 4D of U.S. Pat. No. 5,346,216 which discloses a bulging center that decreases in thickness toward the heel and sole ends, and the top and bottom end of the face, similar to Noble et al. However, the prior art has failed to design a face or face plate that varies the thickness according to predicted golf ball impact points on the face.

What is needed is a light weight face that conforms to the USGA characteristic time test.

BRIEF SUMMARY OF THE INVENTION

The present invention is directed at a face with variable thickness that allows for a lightweight face or face insert that conforms to the USGA characteristic time test. The present invention is able to accomplish this by providing a interior surface that has a first thickness section and a second thickness region.

One aspect of the present invention is a golf club head including a body and a face. The body has a crown, a sole, and a hollow interior. The face is disposed on the body. The face comprises a perimeter section, a heel vertical section, a toe-vertical section and a central horizontal section connected to each of the heel vertical section and toe vertical section. The face also comprises an upper central region, a lower central region, a heel region and a toe region. Each of the perimeter section, the heel vertical section, the toe-vertical section and the central horizontal section has a first thickness and each of the upper central region, the lower central region, the heel region and the toe region has a second thickness. The first thickness is greater than the second thickness by at least 0.025 inch.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
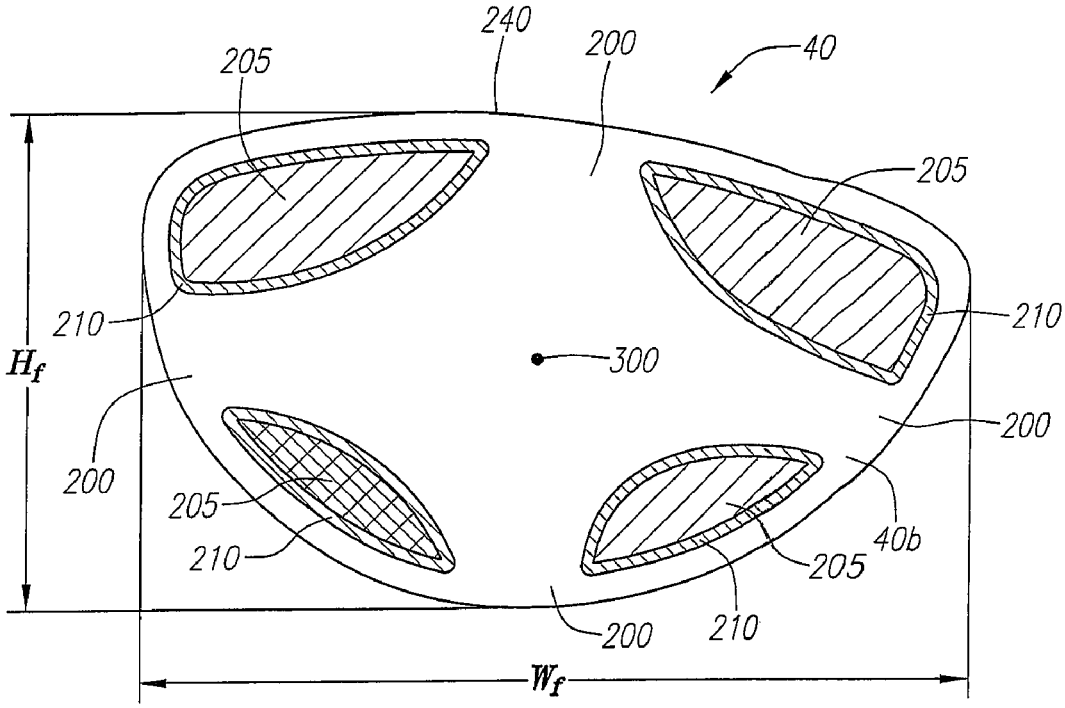
FIG. 1 is a plan isolated view of a preferred embodiment of an interior surface of a face of the present invention.

The present invention is directed at a face for a wood-type golf club head. The face or face insert is generally designated 40. As shown in FIG. 1, a preferred embodiment of the face 40 has a first thickness section 200 in the shape of a cross and a second thickness region 205 defining an interior surface 40*b* of the face 40. A transition portion 210 is disposed between the first thickness section 200 and the second thickness region 205.

Preferably, the first thickness section 200 has a thickness ranging from 0.100 inch to 0.200 inch, and more preferably from 0.125 inch to 0.165 inch, and most preferably approximately 0.155 inch. The second thickness region 205 preferably has a thickness ranging from 0.030 inch to 0.090 inch, more preferably from 0.050 inch to 0.070 inch, and most preferably 0.060 inch. The transition portion 210 preferably has a thickness that tapers from the thickness of the first thickness section 200 to the thickness of the second thickness region 205 to allow for a smooth contouring interior surface 40*b* as opposed to a surface with ribs.

Also in a preferred embodiment, the first thickness section 200 has a thickness that is at least 0.025 inch greater than the thickness of the second thickness region 205. More preferably, the first thickness section 200 has a thickness that is at least 0.050 inch greater than the thickness of the second thickness region 205. Even more preferably, the first thickness section 200 has a thickness that is at least 0.075 inch greater than the thickness of the second thickness region 205. Yet even more preferably, the first thickness section 200 has a thickness that is at least 0.090 inch greater than the thickness of the second thickness region 205.

The thickness within the first thickness section 200 is preferably uniform. However, in an alternative embodiment, the thickness within the first thickness section 200 preferably varies up to 0.020 inch, more preferably up to 0.010 inch, and most preferably up to 0.005 inch. The thickness within the second thickness region 205 is preferably uniform. However, in an alternative embodiment, the thickness within the second thickness region 205 preferably varies up to 0.020 inch, more preferably up to 0.010 inch, and most preferably up to 0.005 inch.

The face or face insert 40 has a perimeter 240 with a top perimeter line 240*a* and a bottom perimeter line 240*b*. As shown in FIG. 1, the face 40 preferably has a width, "Wf", that preferably ranges from 3.50 inches to 5.00 inches, and a height, "Hf", that preferably ranges from 1.80 inches to 2.50 inches. The center of the face 40 is generally designated point 300. The face preferably has a mass ranging from 25 grams to 40 grams and most preferably 29 grams.

Figure 2:
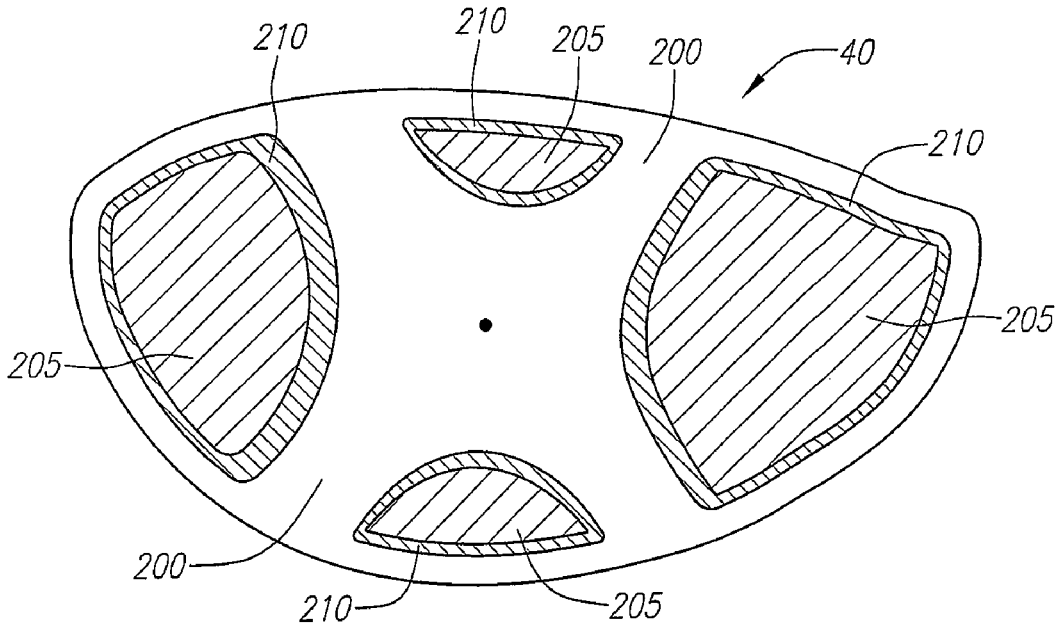
FIG. 2 is a plan isolated view of an alternative embodiment of an interior surface of a face of the present invention.

An alternative embodiment wherein the first thickness section 200 has a "X" shape is shown in FIG. 2. In this embodiment of the face 40, the first thickness section 200, the second thickness region 205 and the transition portion 210 have the same dimensions as discussed above in reference to the embodiment shown in FIG. 1.

Figure 1A:
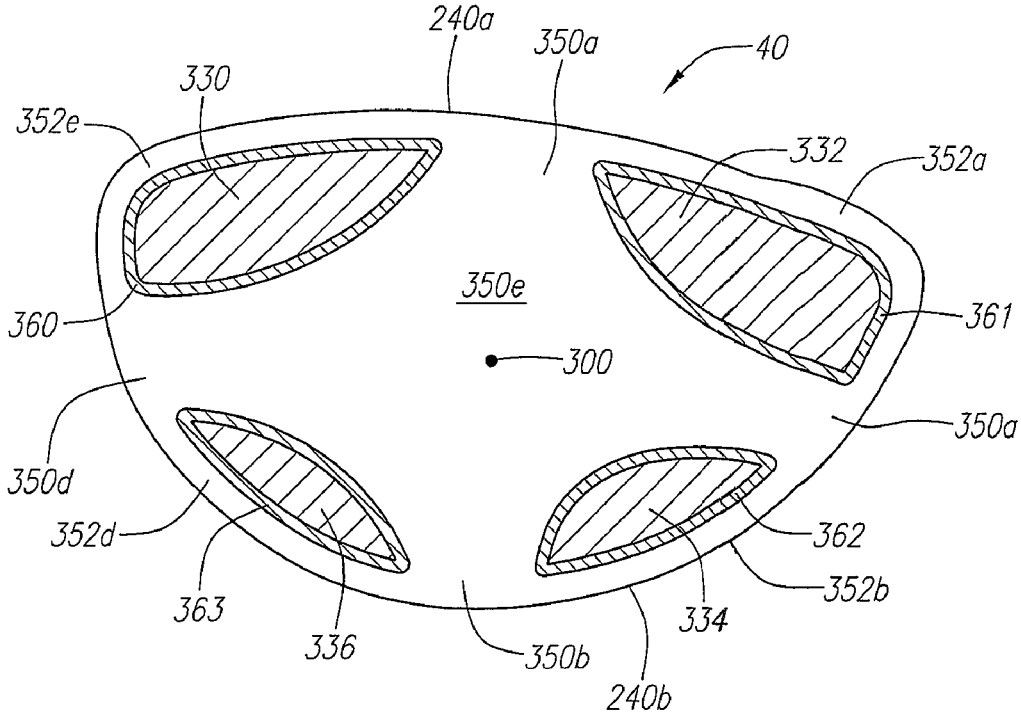
FIG. 1A is a plan isolated view of a preferred embodiment of an interior surface of a face of the present invention.

As shown in FIG. 1A, the first thickness section 200 preferably includes upper extension section 350*a*, lower extension section 350*b*, heel extension section 350*c*, toe extension section 350*d* and central section 350*e*. The second thickness region 205 preferably includes an upper toe region 330, an upper heel region 332, a lower heel region 334 and a lower toe region 236. The first thickness section also preferably includes upper heel perimeter section 352*a*, lower heel perimeter section 352*b*, upper toe perimeter section 352*c* and lower toe section 352*d*. Each of the perimeter sections 352*a-d* defines the perimeter of the face 40 and also partially define each of the second thickness regions 330, 332, 334 and 336.

As shown in FIG. 1A, the transition portion 210 preferably includes a transition upper toe portion 360, a transition upper heel portion 361, a transition lower heel portion 362 and a transition lower toe portion 363. Each of the transition portions 210 has a width from 0.05 inch to 0.15 inch, more preferably from 0.07 inch to 0.11 inch, and most preferably 0.09 inch.

Figure 2A:
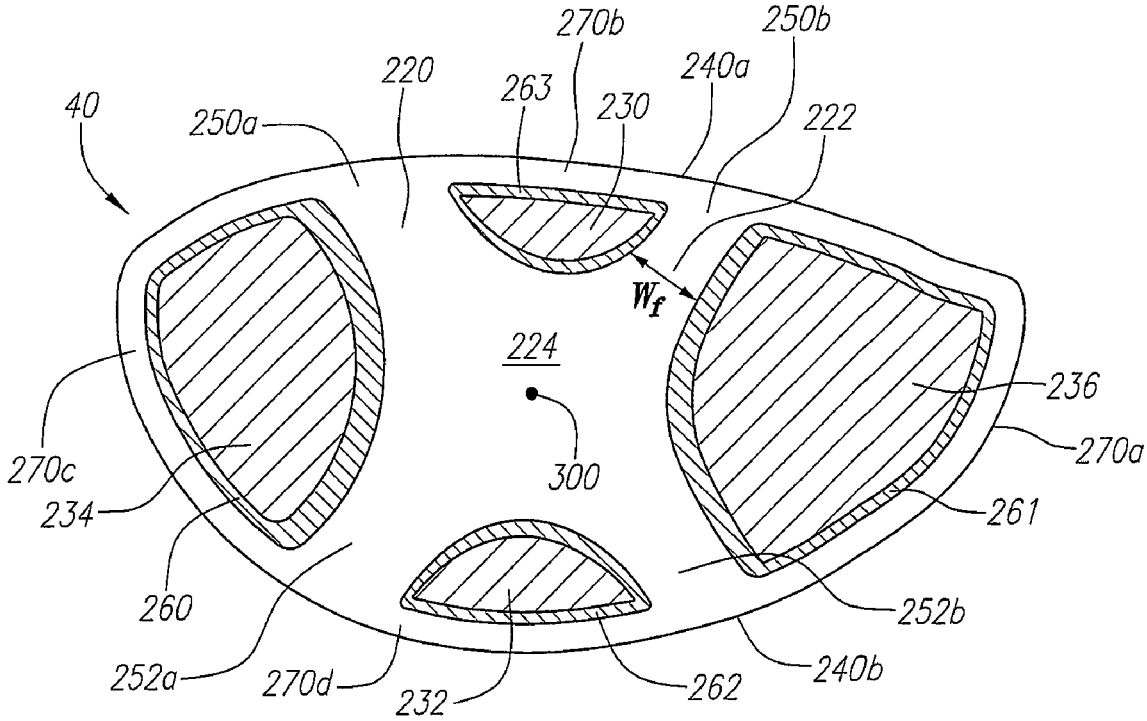
FIG. 2A is a plan isolated view of an alternative embodiment of an interior surface of a face of the present invention.

As shown in FIG. 2A, the first thickness section 200 preferably includes a toe vertical section 220, a heel vertical section 222 and a central horizontal section 224. The heel vertical section 220 and the toe vertical section 222 preferable extend from the top perimeter 240*a* of the face 40 to the bottom perimeter 240*b* of the face 40. The central horizontal section 224 extends between the toe vertical section 220 and the heel vertical section 222, preferably about the face center 300. In a preferred embodiment, each of the toe vertical section 220 and the heel vertical section 222 has a top end 250*a* and 250*b* and bottom end 252*a* and 252*b*. The width of each of the toe vertical section 220 and the heel vertical section 222. "Wv", as shown in FIG. 2A, preferably ranges from 0.15 inch to 0.50 inch, more preferably from 0.20 inch to 0.35 inch, and most preferably 0.275 inch. The first thickness section 200 also preferably includes heel perimeter section 270*a*, upper perimeter section 270*b*, toe perimeter section 270*c* and lower perimeter section 270*d*. Each of the perimeter sections 270*a-d* defines the perimeter of the face 40 and also partially define each of the second thickness regions 230, 232, 234 and 236.

As shown in FIG. 2A, the second thickness region 205 preferably includes an upper central region 230, a lower central region 232, a toe region 234 and a heel region 236.

Each of the upper central region 230 and the lower central region are larger in area than each of the toe region 234 and the heel region 236.

As shown in FIG. 2A, the transition portion 210 preferably includes a transition toe portion 260, a transition heel portion 261, a transition lower portion 262 and a transition upper portion 263. Each of the transition portions 210 has a width from 0.05 inch to 0.15 inch, more preferably from 0.07 inch to 0.11 inch, and most preferably 0.09 inch.

The face or face insert 40 is used with various golf club heads. A preferred embodiment of a golf club head is illustrated in FIGS. 3-10. Alternative embodiments of golf club heads are illustrated in FIGS. 11-18. Although three embodiments are illustrated, those skilled in the pertinent art will recognize from this disclosure that other embodiments of the golf club head using a face or face insert of the present invention are possible without departing from the scope and spirit of the present invention.

A golf club head is generally designated 20. The golf club head 20 has a body 22, which includes a crown 24, a sole 26, a ribbon 28, a front wall 30 and a hollow interior 34. The golf club head 20 has a heel end 36, a toe end 38, and an aft end 37.

The golf club head 20, when designed as a driver, preferably has a volume from 200 cubic centimeters to 600 cubic centimeters, more preferably from 300 cubic centimeters to 500 cubic centimeters, and most preferably from 385 cubic centimeters to 475 cubic centimeters. The golf club head 20 preferably has a mass no more than 250 grams, and most preferably a mass of 170 to 250 grams.

As shown in FIGS. 3-10, in one embodiment of the golf club head 20, the front wall 30 has an opening 32 and preferably a recessed portion 33. The face insert 40 is disposed within the opening 32. The ribbon 28 of the body 22 has an aft-recess 52 located opposite of the face insert 40, and a rear weighting member 50 is disposed within the aft-recess 52. The body 22 is preferably composed of a non-metal material, preferably a composite material such as a continuous fiber pre-preg material (including thermosetting materials or a thermoplastic materials for the resin). Other materials for the body 22 include thermosetting materials or thermoplastic materials such as injectable plastics. The body 22 is preferably manufactured through bladder-molding, resin transfer molding, resin infusion, injection molding, compression molding, or a similar process. Alternatively, the body 22 may be composed of a lightweight metallic material, such as magnesium alloys, aluminum alloys, magnesium, aluminum, titanium, titanium alloys, or other low density metals. The body 22 may also be composed of a steel such as stainless steel or other steel alloys.

The face insert 40 is attached to the body 22 over the opening 32 of the front wall 30. Preferably the face insert 40 is positioned over and attached to the recessed portion 33 of the front wall 30.

The face insert 40 is preferably composed of a formed metal material. However, the face insert 40 may also be composed of a machined metal material, a forged metal material, a cast metal material or the like. The face insert 40 preferably is composed of a titanium or steel material. Titanium materials suitable for the face insert 40 include pure titanium and titanium alloys. Other metals for the face insert 40 include high strength steel alloy metals and amorphous metals. The exterior surface 40*a* of the face insert 40 typically has a plurality of scorelines thereon, not shown.

The face insert 40 is preferably co-molded with the body 22 or press-fitted into the opening 32 subsequent to fabrication of the body 22. In another attachment process, the body 22 is first bladder molded and then the face insert 40 is bonded to the recessed portion 33 of the front wall 30 using an adhesive. The adhesive is placed on the exterior surface of the recessed portion 33. Such adhesives include thermosetting adhesives in a liquid or a film medium. In yet another attachment process, the body 22 is first bladder molded and then the face insert 40 is mechanically secured to the body 22. Those skilled in the pertinent art will recognize that other methods for attachment of the face insert 40 to the body 22 may be composed without departing from the scope and spirit of the present invention.

As mentioned above, the non-metallic body 22 is preferably composed of a plurality of plies of pre-preg, typically six or seven plies (preferably ranging from three plies to twenty plies) such as disclosed in U.S. Pat. No. 6,248,025, entitled Composite Golf Head And Method Of Manufacturing, which is hereby incorporated by reference in its entirety. In such an embodiment, the crown 24, the sole 26 and the ribbon 28 preferably range in thickness from 0.010 inch to 0.100 inch, more preferably from 0.025 inch to 0.070 inch, even more preferably from 0.028 inch to 0.040 inch, and most preferably have a thickness of 0.033 inch. The front wall 30 preferably has a thickness greater than the thickness of the crown 24, sole 26 or ribbon 28. The thickness of the front wall preferably ranges from 0.030 to 0.150 inch, more preferably from 0.050 inch to 0.100 inch, even more preferably from 0.070 inch to 0.090 inch, and most preferably the front wall 30 has a thickness of 0.080 inch.

Figure 6:
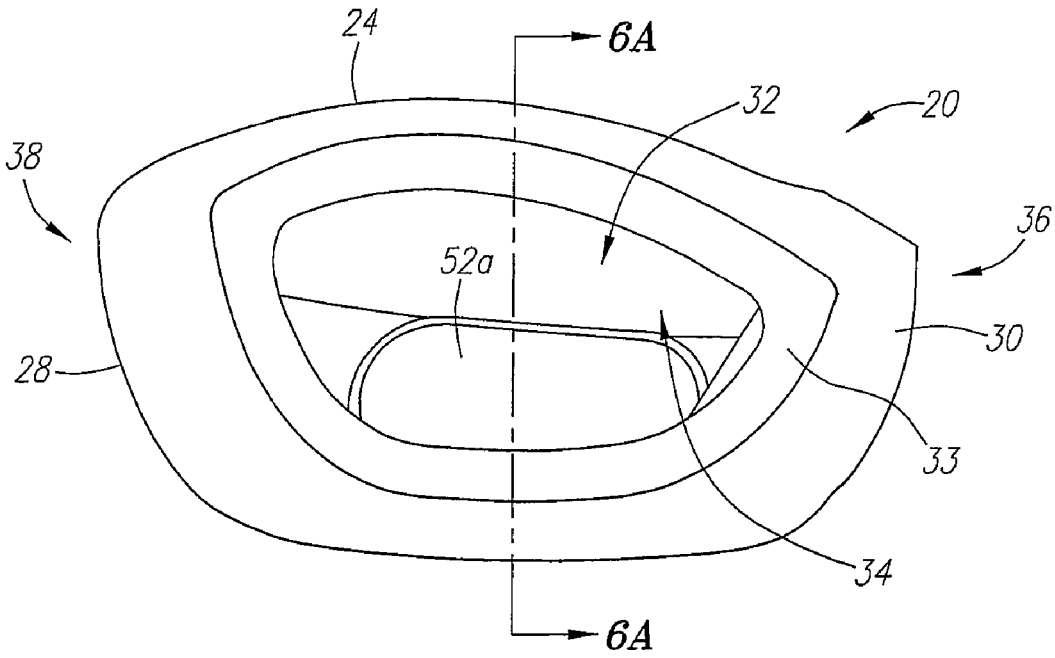
FIG. 6 is a front view of the body of a golf club head of FIG. 3.
Figure 6A:
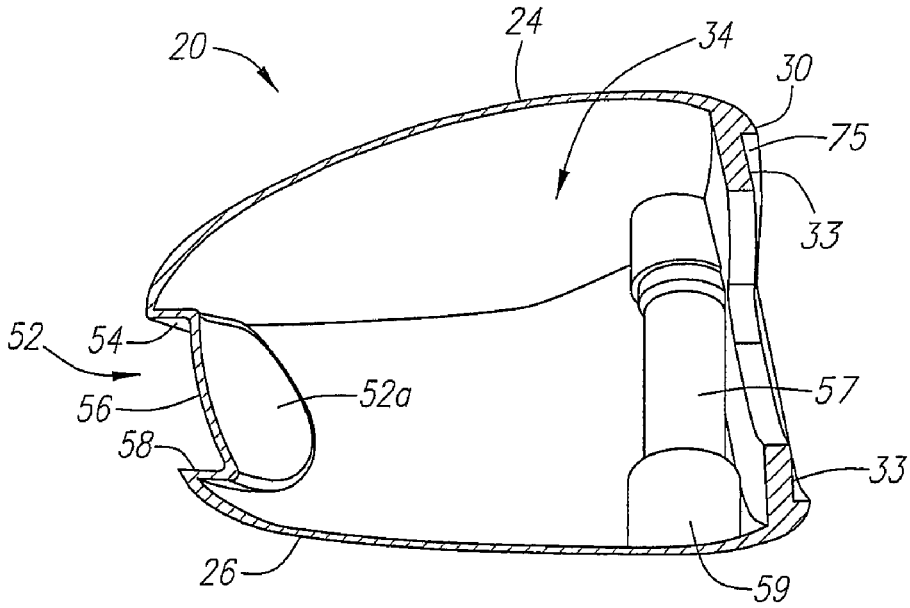
FIG. 6A is a cross-sectional view taken along the line 6A-6A of FIG. 6.
Figure 7:
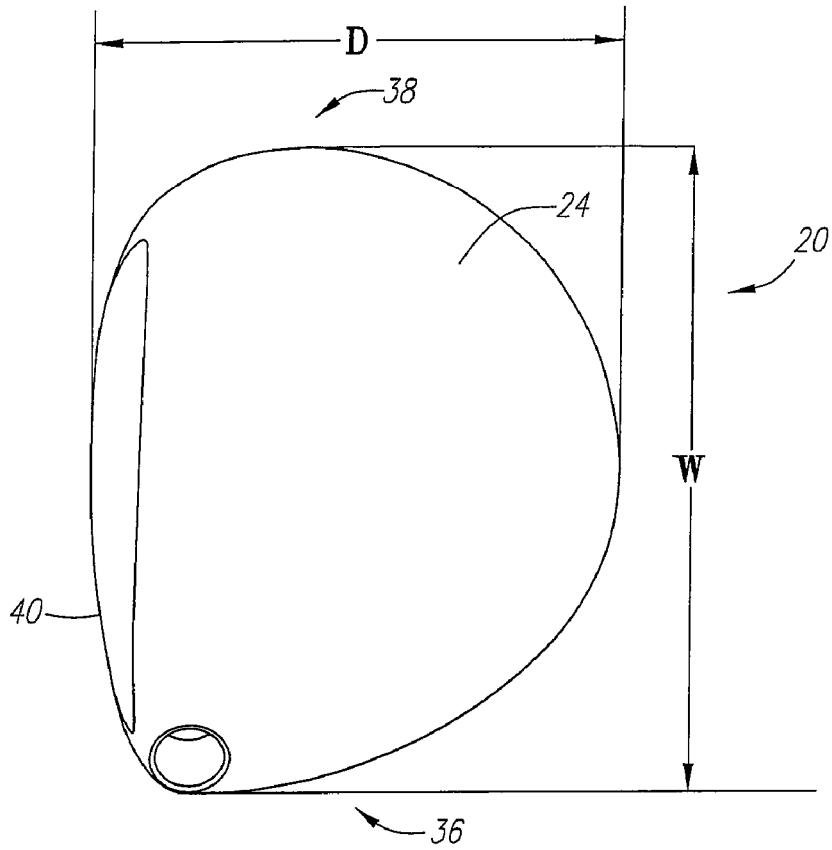
FIG. 7 is a top plan view of a golf club head illustrating the Y axis and X axis.
Figure 8:
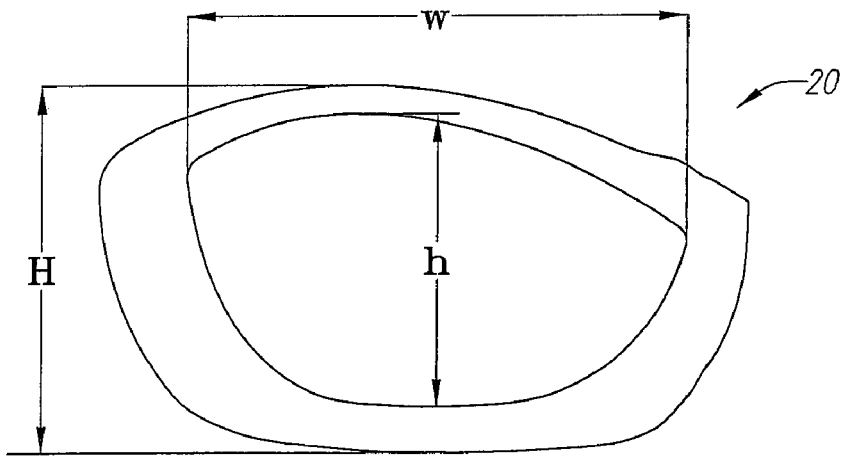
FIG. 8 is a front view of a golf club head.

FIGS. 6 and 6A best illustrate the hollow interior 34 of the club head 20. As shown in FIGS. 6 and 6A, the recessed portion 33 of the front wall 30 encompasses the opening 32 forming a support for placement and attachment of the face insert 40 thereon. The front wall 30 has a shoulder 75 that preferably engages a perimeter 77 of the face insert 40. A portion of the interior surface of the face insert 40 will engage the exterior surface of the recessed portion 33 of the front wall 30. The thickness of the recessed portion 33 of the front wall 30 is preferably thicker than the crown 24, the sole 26 or the ribbon 28.

Also shown in FIG. 6A is the hosel 57, which is disposed within the hollow interior 34, and is located near the heel end 36. The hosel 57 is preferably composed of an aluminum material, and preferably has a mass ranging from 3 to 10 grams, more preferably from 4 to 8 grams, and most preferably has a mass of 6 grams. Alternatively, the hosel 57 may be composed of a strong polymer material such as a urethane or ABS material. A shaft, not shown, is disposed within the hosel 57 through a bore 55 in the crown 24. A hosel insert, not shown, is preferably used to interface between the shaft and the hosel 57. Such a hosel insert is described in U.S. Pat. No. 6,352,482, entitled Golf Club With Hosel Liner, which pertinent parts are hereby incorporated by reference. The hosel 57 is preferably positioned in a hosel base 59 and extends from the sole 26 to the crown 24. However, those skilled within the pertinent art will recognize that the hosel need not extend all the way to the side 26 and may also extend outside of the body 22 without departing from the scope and spirit of the present invention.

Figure 3:
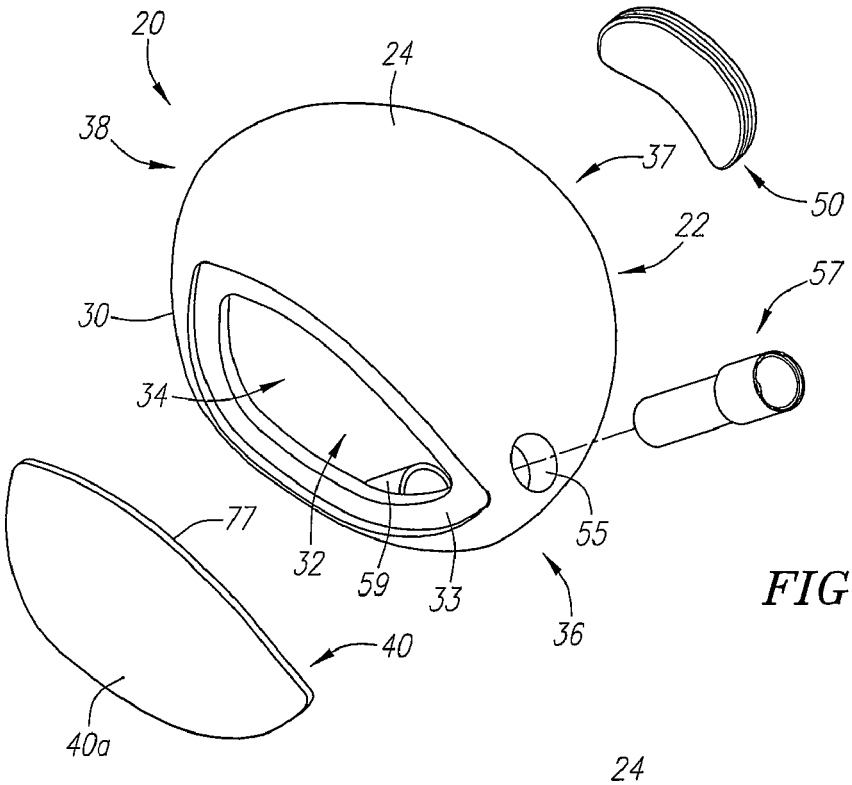
FIG. 3 is an exploded top perspective view of a golf club head.
Figure 4:
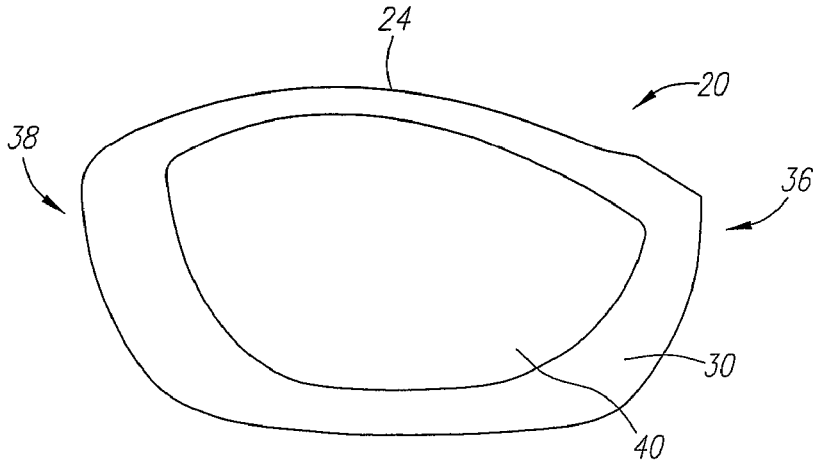
FIG. 4 is a front view of a golf club head of FIG. 3.
Figure 5:
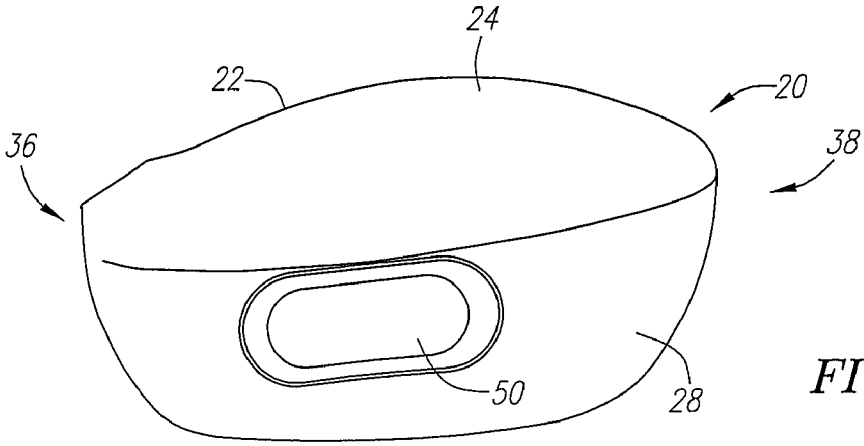
FIG. 5 is a rear view of a golf club head of FIG. 3.

Also shown in FIGS. 6 and 6*a* are the walls of the aft recess 52. The aft recess 52 preferably extends into the hollow interior 34 forming an aft recess projection 52*a*. The aft recess 52 is preferably defined by upper recess wall 54, main recess wall 56 and lower recess wall 58. The rear weighting member 50 is positioned within the aft recess 52, as best shown in FIG. 3.

The rear weighting member 50 is preferably composed of a metal material such as steel, steel alloys, brass, tungsten, tungsten alloys, or other high density materials. The rear weighting member 50 is preferably co-molded with a body 22 or press-fitted within the aft recess 52 subsequent to fabrication of the body 22. In another attachment process, the body 22 is first bladder molded and then the rear weighting member 50 is bonded within the aft recess 52 using an adhesive.

Figure 13:
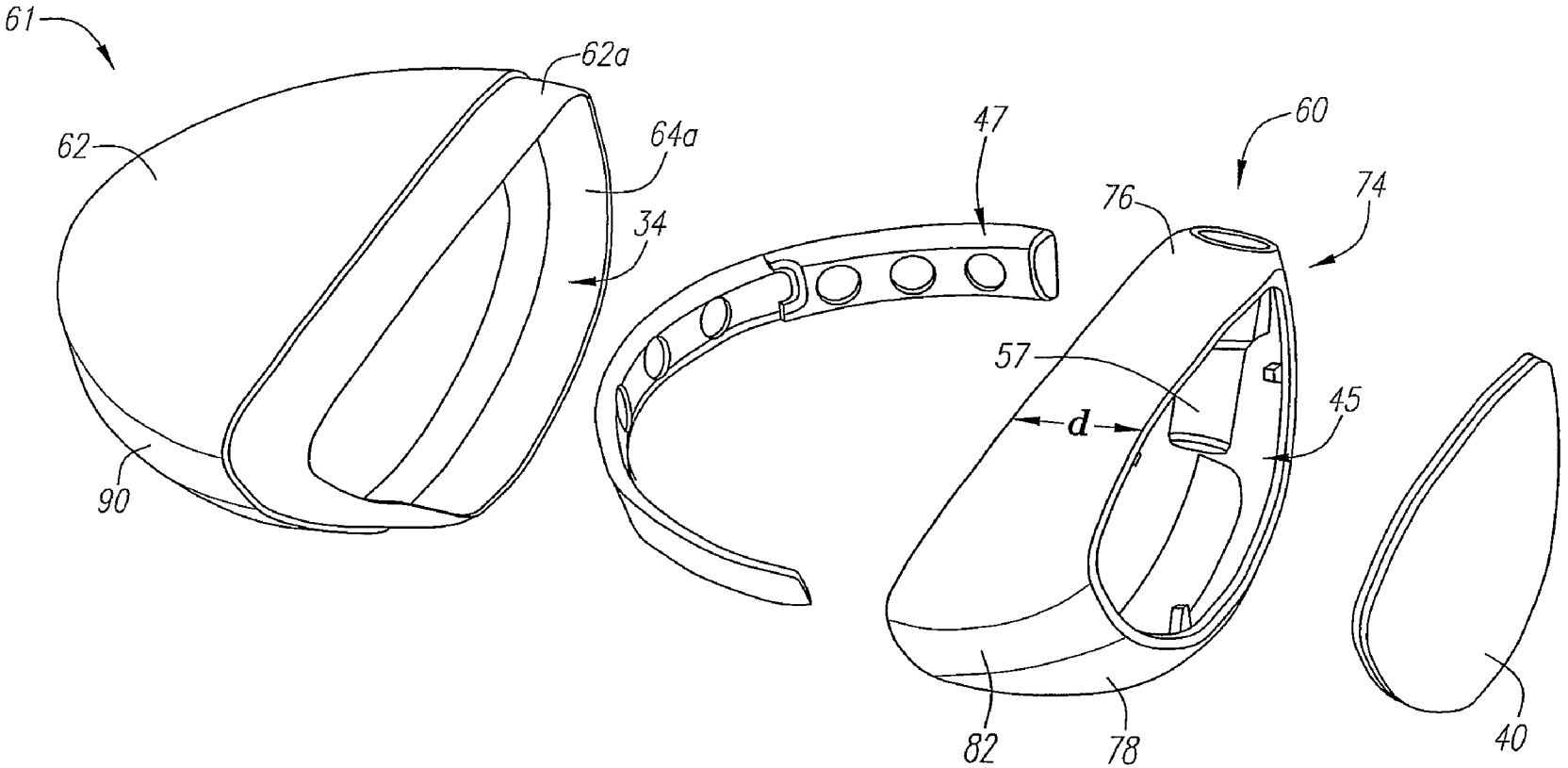
FIG. 13 is an exploded top perspective of a golf club head of according to the fourth embodiment of the present invention.
Figure 14:
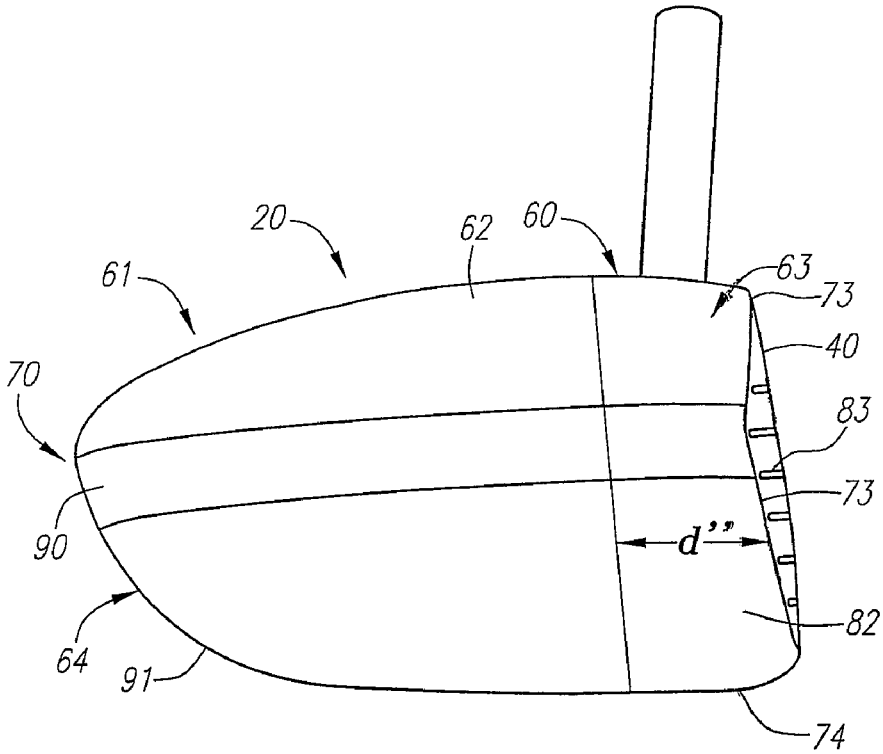
FIG. 14 is a toe side view of the golf club head of FIG. 13.
Figure 15:
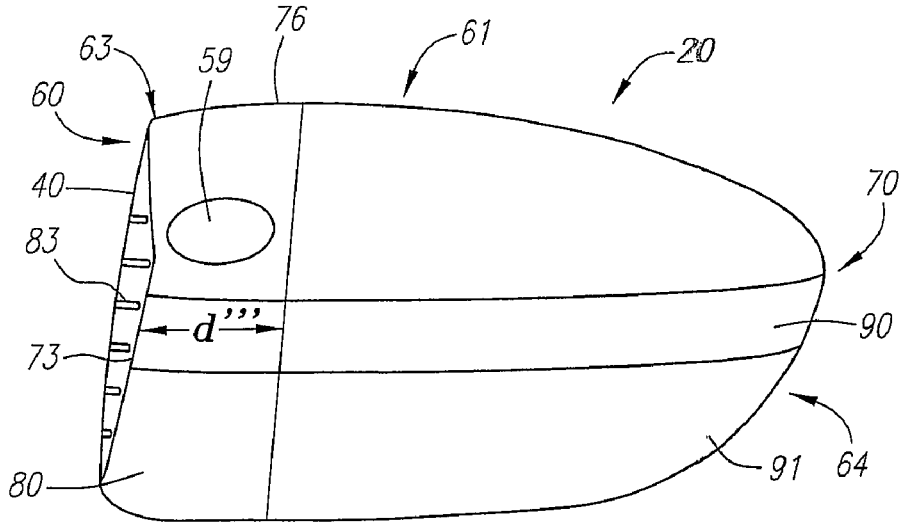
FIG. 15 is a heel side view of the golf club head of FIG. 13.

A second embodiment of the golf club head 20 is shown in FIGS. 13-15, such as disclosed in U.S. Pat. No. 6,565,452, for a Multiple Material Golf Club Head with Face Insert, filed on Feb. 28, 2002, and is hereby incorporated by reference in its entirety. In this embodiment, the golf club head 20, a face component 60 and an aft-body 61. The face component 60 has a face cup and has a separate face insert 40, which is placed within an opening 45 of a face cup 74. The aft-body 61 has a crown portion 62 and a sole portion 64.

The face cup 74 has a return portion 63 that extends laterally rearward from the perimeter 73 of the front wall. The face insert 40 is joined to the face cup 74 of the face component 60 in a manufacturing process discussed in co-pending U.S. application Ser. No. 10/710,143, entitled Method for Processing a Golf Club Head with Cup Shaped Face Component, filed on Jun. 22, 2004, and hereby incorporated by reference in its entirety.

The return portion 63 of the face cup preferably includes an upper lateral section 76, a lower lateral section 78, a heel lateral section 80 and a toe lateral section 82. Thus, the return portion 63 preferably encircles the face insert 40 a full 360 degrees. However, those skilled in the pertinent art will recognize that the return portion 63 may only encompass a partial section of the face insert 40, such as 270 degrees or 180 degrees, and may also be discontinuous.

The upper lateral section 76 extends rearward, towards the aft-body 61, a predetermined distance, d, to engage the crown 62. In a preferred embodiment, the predetermined distance ranges from 0.2 inch to 1.0 inch, more preferably 0.40 inch to 0.75 inch, and most preferably 0.68 inch, as measured from the perimeter 73 of the face insert 40 to the rearward edge of the upper lateral section 76. In a preferred embodiment, the upper lateral section 76 has a general curvature from the heel end 36 to the toe end 38. The upper lateral section 76 has a length from the perimeter 73 of the face insert 40 that is preferably a minimal length near the center of the face insert 40, and increases toward the toe end 38 and the heel end 36. However, those skilled in the relevant art will recognize that the minimal length may be at the heel end 36 or the toe end 38.

The face component 60 engages the crown portion 62 of the aft-body 61 along a substantially horizontal plane. The crown portion 62 has a crown undercut portion 62*a*, which is placed under the return portion 63. Such an engagement enhances the flexibility of the face insert 40 allowing for a greater coefficient of restitution. The crown portion 62 of the aft-body 61 and the upper lateral section 76 of the face component 60 are attached to each other as further explained below.

The heel lateral section 80 is substantially perpendicular to the face insert 40, and the heel lateral section 80 covers the hosel 57 before engaging an optional ribbon section 90 and a bottom section 91 of the sole portion 64 of the aft-body 61. The heel lateral section 80 is attached to the sole portion 64, both the ribbon 28 and the bottom section 91, as explained in greater detail below. The heel lateral section 80 extends inward a distance, d'", from the perimeter 73 a distance of 0.250 inch to 1.50 inches, more preferably 0.50 inch to 1.0 inch, and most preferably 0.950 inch. The heel lateral section 80 preferably has a general curvature at its edge.

At the other end of the face component 60 is the toe lateral section 82. The toe lateral section 82 is attached to the sole portion 64, both the ribbon 28 and the bottom section 91, as explained in greater detail below. The toe lateral section 82 extends inward a distance, d", from the perimeter 73 a distance of 0.250 inch to 1.50 inches, more preferably 0.75 inch to 1.30 inch, and most preferably 1.20 inch. The toe lateral section 82 preferably has a general curvature at its edge.

The lower lateral section 78 of the face component 60 extends inward, toward the aft-body 61, a predetermined distance to engage the sole portion 64. In a preferred embodiment, the predetermined distance ranges from 0.2 inch to 1.25 inches, more preferably 0.50 inch to 1.10 inch, and most preferably 0.9 inch, as measured from the perimeter 73 of the face insert 40 to the edge of the lower lateral section 78. In a preferred embodiment, the lower lateral section 78 has a general curvature from the heel end 36 to the toe end 38. The lower lateral section 78 has a length from the perimeter 73 of the face section 72 that is preferably a minimal length near the center of the face section 40, and increases toward the toe end 38 and the heel end 36.

The sole portion 64 has a sole undercut 64*a* for placement under the return portion 63. The sole 64 and the lower lateral section 78, the heel lateral section 80 and the toe lateral section 82 are attached to each other as explained in greater detail below.

The aft-body 61 is preferably composed of a non-metal material, preferably a composite material such as continuous fiber pre-preg material (including thermosetting materials or a thermoplastic materials for the resin). Other materials for the aft-body 61 include other thermosetting materials or other thermoplastic materials such as injectable plastics. The aft-body 61 is preferably manufactured through bladder-molding, resin transfer molding, resin infusion, injection molding, compression molding, or a similar process. Alternatively, the aft-body may be composed of a metallic material such as magnesium, titanium, stainless steel, or any other steel or titanium alloy.

The crown portion 62 of the aft-body 61 is generally convex toward the sole portion 64, and engages the ribbon section 90 of sole portion 64 outside of the engagement with the face member 60. Those skilled in the pertinent art will recognize that the sole portion 64 may not have a ribbon section 90. The crown portion 62 preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch. The sole portion 64, including the bottom section 91 and the optional ribbon section 90 which is substantially perpendicular to the bottom section 91, preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch.

The assembled face component 60 may then be attached to the aft body 61. The face component 60, with an adhesive on the interior surface of the return portion 63, is placed within a mold with a preform of the aft-body 61 for bladder molding. The return portion 63 is placed and fitted into the undercut portions 62*a* and 64*a*. Also, the adhesive may be placed on the undercut portions 62*a* and 64*a*. Such adhesives include thermosetting adhesives in a liquid or a film medium. During this attachment process, a bladder is placed within the hollow interior of the preform and face component 60, and is pressurized within the mold, which is also subject to heating. The co-molding process secures the aft-body 61 to the face component 60. In another attachment process, the aft-body 61 is first bladder molded and then is bonded to the face component 60 using an adhesive, or mechanically secured to the return portion 63.

Figure 16:
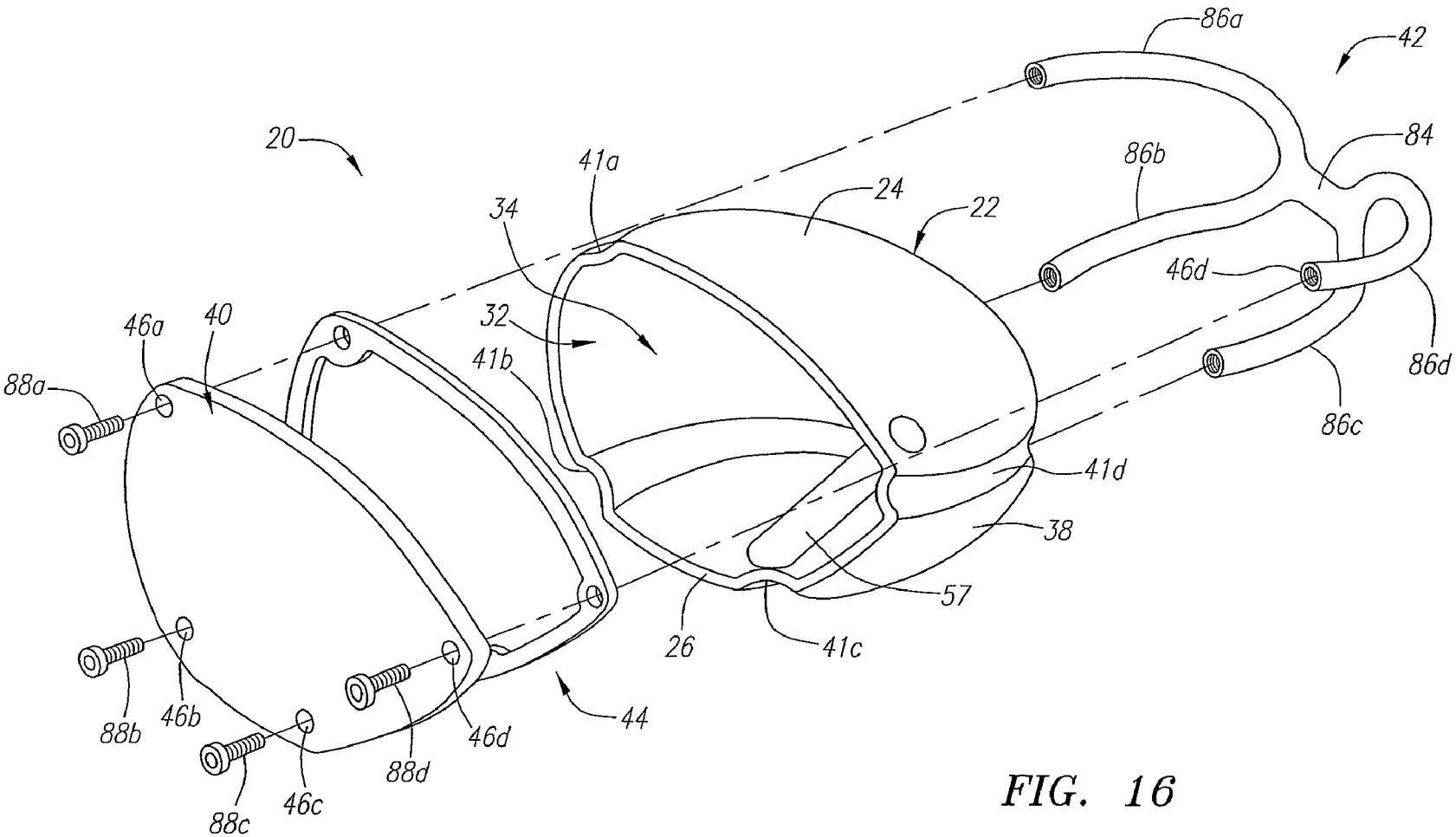
FIG. 16 is an exploded top perspective of the golf club head according to the fifth embodiment of the present invention.
Figure 17:
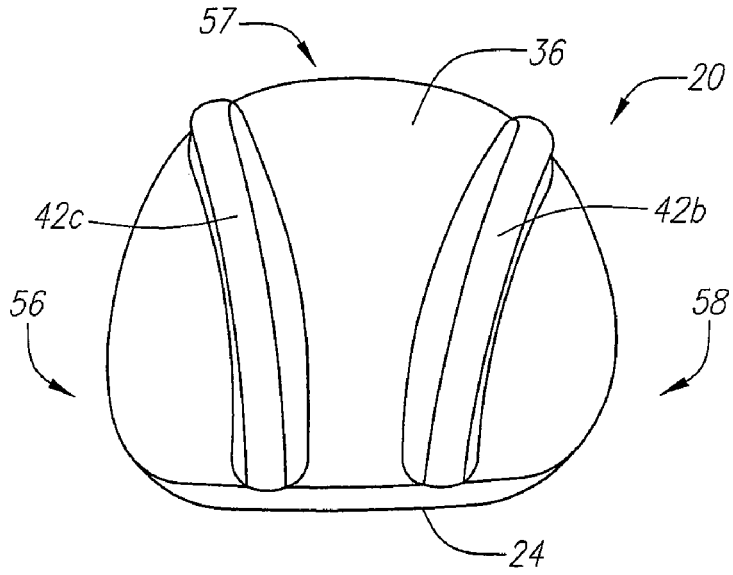
FIG. 17 is a bottom plan view of the golf club head of FIG. 16.
Figure 18:
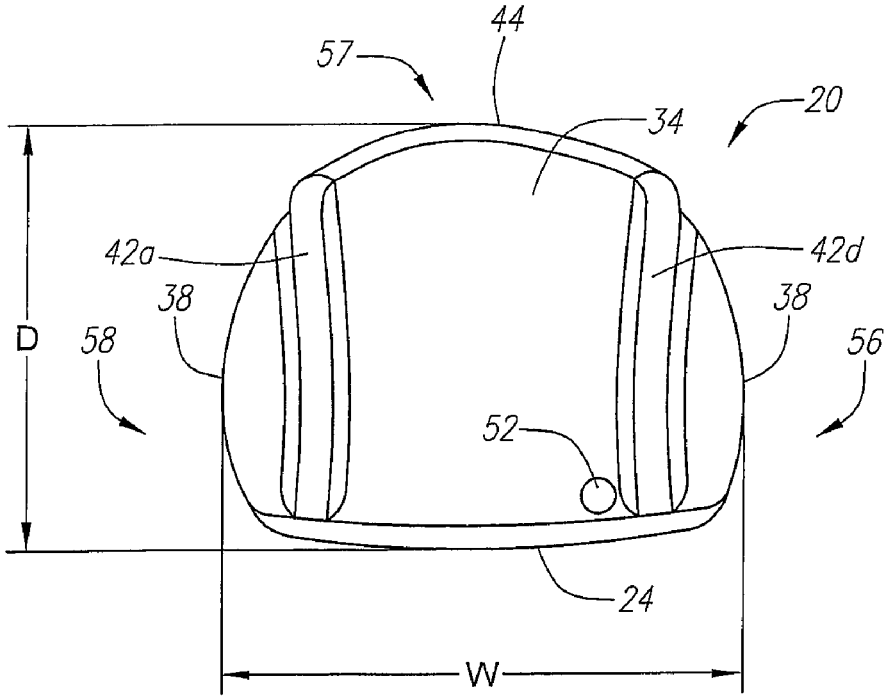
FIG. 18 is a top plan view of the golf club head of FIG. 16.

A third embodiment of the golf club head 20 is shown in FIGS. 16-18. In this embodiment, the golf club head 20 includes a body 22, a face 40 a weighting frame 42, and an optional support gasket 44. A more thorough description of such a golf club head 20 is set forth in U.S. Pat. No. 6,672,975, for a Golf Club Head, and assigned to the assignee of the present application, and which is hereby incorporated by reference in its entirety.

The body 22 is preferably composed of a light weight or low-density material, preferably a non-metal material or a low-density (less than 4.5 grams per cubic centimeter) metal material, such as a polycarbonate material. Other materials for the body 22 include a composite material such as a continuous fiber pre-preg material (including thermosetting materials or a thermoplastic material for the resin), other thermosetting materials such as thermosetting polyurethane, or other thermoplastic materials such as polyamides, polyimides, polycarbonates, PBT (Polybutlene Terephthalate), blends of polycarbonate and polyurethane, and the like. The body 22 is preferably manufactured through injection molding, bladder-molding, resin transfer molding, resin infusion, compression molding, or a similar process. A preferred metal material for the body 22 is aluminum, tin or magnesium. The face 40 is attached to the frame 42 and over the opening 32. Preferably the face 40 is positioned over and attached to the support gasket 44.

The face 40 is preferably composed of a formed metal material, however, the face 40 may also be composed of a machined metal material, a forged metal material, a cast metal material or the like. The face 40 preferably is composed of a formed titanium or steel material. Titanium materials useful for the face 40 include pure titanium and titanium alloys. Other metals for the face 40 include other high strength steel alloy metals and amorphous metals. The exterior surface of the face 40 typically has a plurality of scorelines thereon, not shown.

The face 40 preferably has an elliptical shape or a trapezoidal shape. The face 40 preferably has a plurality of holes 46*a-d* for insertion of the bolts 88*a-d* there through.

The weighting frame 42 is preferably composed of a metal material such as stainless steel, titanium alloy, aluminum, magnesium and other like metal materials. In an alternative embodiment, the weighting frame 42 is composed of a thermoplastic material. The frame 42 is preferably composed of four arms 86*a-d* and a central body 84. In the preferred embodiment, each of the arms 86*a-d* are positioned within a corresponding groove 40*a-d* of the body 22. Each of the grooves 40*a-d* are generally shaped to receive an arm 86*a-d*. Each arm 86*a-d* has a length sufficient to extend from the aft end 37 of the body 22 to the opening 32. In a preferred embodiment, each arm 86*a-d* is tubular with a threaded aperture at the forward end (opposite the central body 84) to receive a bolt for attachment of the face 40 thereto. The frame 42 preferably engages the face 40 at each of the corners (upper heel, lower heel, upper toe and lower toe) of the face 40. The frame 42 also increases the moment of inertia of the golf club head 20 since mass is positioned at the outer extremes of the golf club head 20.

Further, the attachment of the face 40 to the frame 42 provides the ability to use an amorphous metal for the face 40 and a different material for the frame 42 and the body 22 thereby eliminating problems associated with bonding amorphous metals to other metals. Although attachment through the use of bolts is preferred, other joining means may be utilized such as riveting, self taping screws, localized friction or welding, spot welding, local bonding, melt or solvent bonding, and the like.

Preferably, the frame 42 has a mass ranging from 30 grams to 90 grams, more preferably from 40 grams to 70 grams. The hosel 57 preferably has a mass ranging from 3 to 10 grams, more preferably from 4 to 8 grams, and most preferably has a mass of 6 grams. Additionally, epoxy, or other like flowable materials, in an amount ranging from 0.5 grams to 5 grams, may be injected into the hollow interior 50 of the golf club head 20 for selective weighting thereof.

As shown in FIGS. 17 and 18, the depth, D, of the club head 20 from the face 40 to the after end 37 of the crown 24 preferably-ranges from 3.0 inches to 4.5 inches, and is most preferably 3.74 inches. The height of the club head 20, as measured while in address position from the sole 26 to the crown 24, preferably ranges from 2.0 inches to 3.5 inches, and is most preferably 2.62 inches. The width, W, of the club head 20 from the toe end 38 to the heel end 36 preferably ranges from 4.0 inches to 5.5 inches, and more preferably 4.57 inches. The height of the face 40, preferably ranges from 1.8 inches to 2.5 inches, and is most preferably 2.08 inches. The width, w, of the face insert from the toe end to the heel end preferably ranges from 3.0 inches to 5.0 inches, and more preferably 3.52 inches.

The golf club head 20 preferably has a high coefficient of restitution for greater distance of a golf ball hit with the golf club head of the present invention. The coefficient of restitution (also referred to herein as "COR") is determined by the following equation:

$$e = \frac{v_2 - v_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The golf club head 20 preferably has a coefficient of restitution ranging from 0.80 to 0.94, as measured under conventional test conditions.

The coefficient of restitution of the club head 20 of the present invention under standard USGA test conditions with a given ball preferably ranges from approximately 0.80 to 0.94, more preferably ranges from 0.82 to 0.89 and is most preferably 0.86. However, the face center 300 preferably has a COR no greater than 0.83, and the golf club head 20 preferably conforms the USGA characteristic time test.

Figure 9:
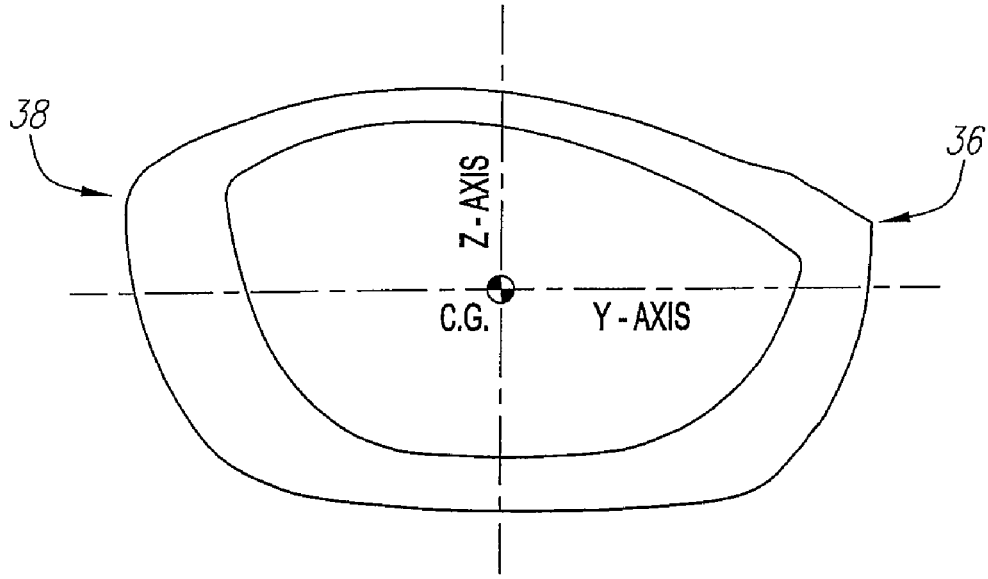
FIG. 9 is a front plan view of a golf club head of the present invention illustrating the Z axis and Y axis.
Figure 10:
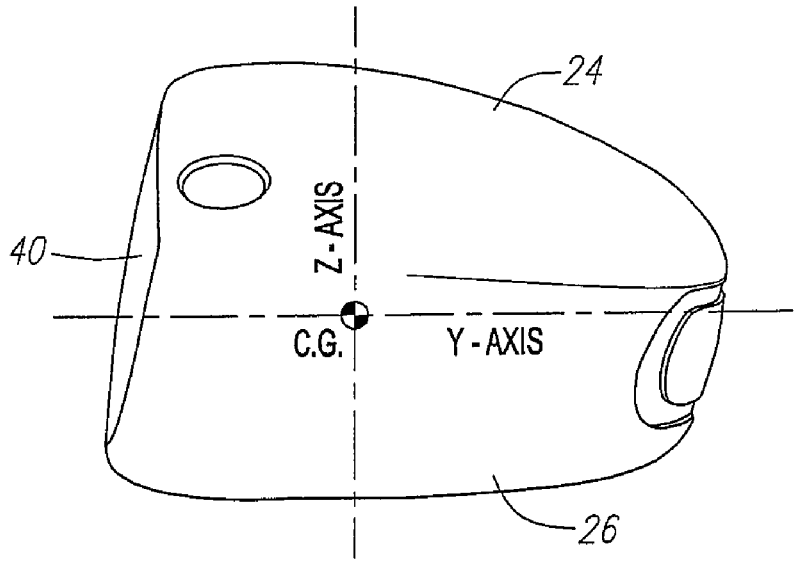
FIG. 10 is a heel side plan view of a golf club of the present invention illustrating the Z axis and X axis.
Figure 11:
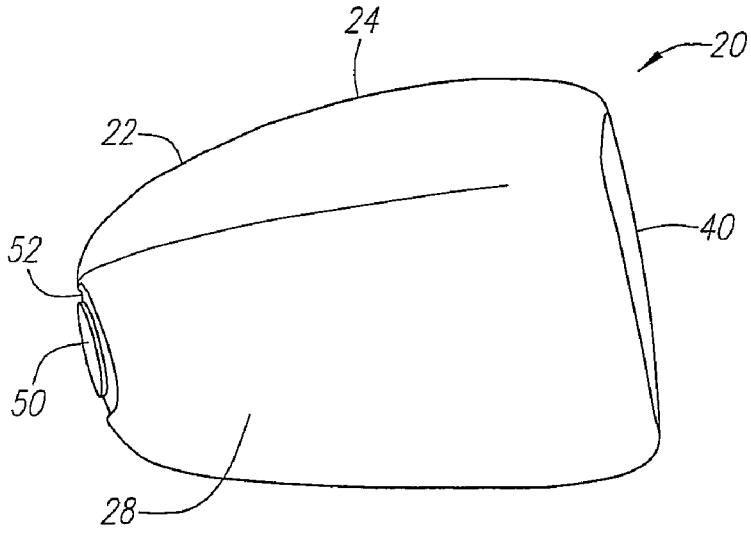
FIG. 11 is a toe side view of the golf club head of FIG. 3.
Figure 12:
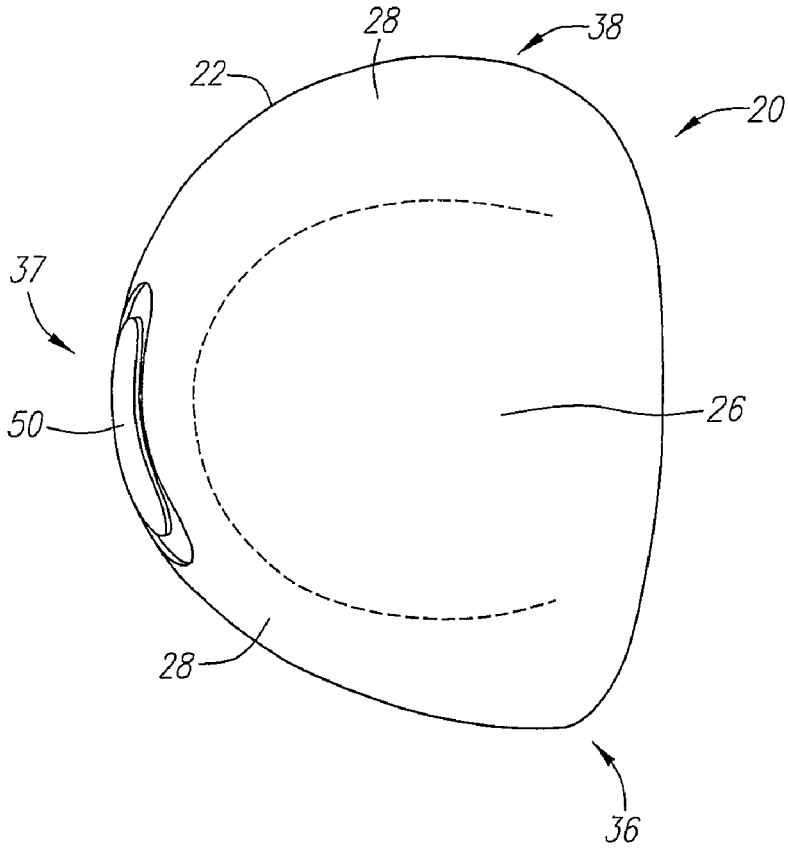
FIG. 12 is a bottom plan view of the golf club head of FIG. 3.

FIGS. 9 and 10 illustrate the axes of inertia through the center of gravity of the golf club head. The axes of inertia are designated X, Y and Z. The X axis extends from the face insert 40 through the center of gravity, CG, and to the rear of the golf club head 20. The Y axis extends from the toe end 38 of the golf club head 20 through the center of gravity, CG, and to the heel end 36 of the golf club head 20. The Z axis extends from the crown 24 through the center of gravity, CG, and to the sole 26.

As defined in *Golf Club Design, Fitting, Alteration & Repair,* 4$^{th}$ Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in *Golf Club Design, Fitting, Alteration & Repair.*

The center of gravity and the moment of inertia of a golf club head 20 are preferably measured using a test frame ($X^T$, $Y^T$, $Z^T$), and then transformed to a head frame ($X^H$, $Y^H$, $Z^H$). The center of gravity of a golf club head may be obtained using a center of gravity table having two weight scales thereon, as disclosed in U.S. Pat. No. 6,607,452, entitled High Moment Of Inertia Composite Golf Club, and hereby incorporated by reference in its entirety. If a shaft is present, it is removed and replaced with a hosel cube that has a multitude of faces normal to the axes of the golf club head. Given the weight of the golf club head, the scales allow one to determine the weight distribution of the golf club head when the golf club head is placed on both scales simultaneously and weighed along a particular direction, the X, Y or Z direction.

In general, the moment of inertia, Izz, about the Z axis for the golf club head 20 is preferably greater than 3000 g-cm$^2$, and more preferably greater than 3500 g-cm$^2$. The moment of inertia, Iyy, about the Y axis for the golf club head 20 is preferably in the range from 2000 g-cm$^2$ to 4000 g-cm$^2$, more preferably from 2300 g-cm$^2$ to 3800 g-cm$^2$. The moment of inertia, Ixx, about the X axis for the golf club head 20 is preferably in the range from 1500 g-cm$^2$ to 3800 g-cm$^2$, more preferably from 1600 g-cm$^2$ to 3100 g-cm$^2$.

Table One illustrates a comparison of a golf club head with a face insert (40) of the present invention as compared to a golf club head with a face insert having a uniform thickness. Both golf club head conform to the USGA regulations for characteristic time. The golf club head 20 with the face insert (40) having a H-shaped first thickness section 200 has a mass that is more than 25% lighter than the uniform thickness face of the comparison golf club head while having similar CORs and characteristic times.

| Face Design | Mass (grams) | Characteristic Time (μs) | COR | Thickness (inches) |
|---|---|---|---|---|
| Uniform | 42.7 | 240 | 0.828 | 0.120 |
| H-shaped | 29.0 | 240 | 0.829 | variable |

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:

a body comprising a crown, a sole, a heel region, a toe region and a hosel area for receiving a shaft;

a face insert attached to the body, the face insert comprising a perimeter section, a heel vertical section, a toe-vertical section and a central horizontal section connected to each of the heel vertical section and toe vertical section, the face also comprising an upper central region, a lower central region, a heel region and a toe region, wherein the each of the perimeter section, the heel vertical section, the toe-vertical section and the central horizontal section has a first thickness and each of the upper central region, the lower central region, the heel region and the toe region has a second thickness, and the first thickness is greater than the second thickness by at least 0.025 inch, the face insert composed of a metal material.

2. The golf club head according to claim 1 wherein the face insert further comprises a transition section which transitions from the first thickness to the second thickness.

3. The golf club head according to claim 1 wherein the first thickness is greater than the second thickness by at least 0.050 inch.

4. The golf club head according to claim 1 wherein each of the perimeter section, the heel vertical section, the toe-vertical section and the central horizontal section has a thickness ranging from 0.100 inch to 0.200 inch, and each of the upper central region, the lower central region, the heel region and the toe region has a thickness ranging from 0.030 inch to 0.090 inch.

5. The golf club head according to claim 4 wherein each of the heel-vertical section and the toe vertical section extend from a bottom of the insert to a top of the insert.

6. The golf club head according to claim 1 wherein each of the perimeter section, the heel vertical section, the toe-vertical section and the central horizontal section has a thickness ranging from 0.125 inch to 0.165 inch, and each of the upper central region, the lower central region, the heel region and the toe region has a thickness ranging from 0.050 inch to 0.070 inch.

7. The golf club head according to claim 1 wherein the heel-vertical section, the toe vertical section and the central horizontal section form an X shape.

* * * * *